United States Patent [19]

Luhman

[11] Patent Number: 4,848,066

[45] Date of Patent: Jul. 18, 1989

[54] METHOD AND APPARATUS FOR ASSEMBLING BLISTER PACKAGES

[75] Inventor: Robert A. Luhman, St. Paul, Minn.

[73] Assignee: Minnesota Mining and Manufacturing Company, St. Paul, Minn.

[21] Appl. No.: 184,344

[22] Filed: Apr. 21, 1988

[51] Int. Cl.[4] ..... B65B 7/00; B65B 7/28; B65B 61/00

[52] U.S. Cl. ..... 53/485; 53/137; 53/329; 53/390; 53/420; 156/556

[58] Field of Search ..... 53/137, 281, 329, 371, 53/390, 420, 467, 471, 485; 156/259, 555, 556, 566

[56] References Cited

U.S. PATENT DOCUMENTS

| | | | |
|---|---|---|---|
| 3,849,972 | 11/1974 | Pepmeier et al. | 53/329 |
| 4,083,737 | 4/1978 | Foote et al. | 156/556 |
| 4,326,704 | 4/1982 | Barr | 156/552 |
| 4,565,047 | 1/1986 | Nishikawa et al. | 53/137 |
| 4,612,755 | 9/1986 | Cavanagh . | |
| 4,620,891 | 11/1986 | Applegate et al. | 53/137 |
| 4,684,433 | 8/1987 | Gohr | 156/259 |

*Primary Examiner*—Robert L. Spruill
*Assistant Examiner*—Ann Tran
*Attorney, Agent, or Firm*—Merchant, Gould, Smith, Edell, Welter & Schmidt

[57] ABSTRACT

Apparatus and method for assembling a backing card to a plastic blister using strips of double-coated pressure-sensitive adhesive tape. Parallel feed wheels are rotatably mounted for wrapping and transporting tape from tape rolls to an application station from where the tape can be transferred from the wheels to the backing card. Cutting blades are provided for cutting the tape at both ends to form tape strips to be transferred to the backing card. A hingeably mounted tray supports and positions a backing card over the feed wheel surfaces. A pair of rollers are mounted on a carriage and are used to press the backing card onto the surfaces of the feed wheel to transfer tape on the surfaces to the backing card. A blister fixture is further provided for holding a blister to be assembled to a taped backing card. The carriage further supports the rollers for rolling movement over a blister card in the fixture to seal them together.

13 Claims, 3 Drawing Sheets

METHOD AND APPARATUS FOR ASSEMBLING BLISTER PACKAGES

TECHNICAL FIELD OF THE INVENTION

This invention relates to blister packages, in particular to a device for assembling a plastic blister and a paper board card to form a blister package.

BACKGROUND OF THE INVENTION

U.S. patent application Ser. No. 100,786, entitled "Blister Package," and filed Sept. 25, 1987, discloses a double-coated pressure-sensitive adhesive tape which can be used to assemble a blister package. More particularly, strips of the tape can be used to seal a plastic blister to a backing card. The tape is positioned between the card and the flanges of the blister and the blister and card are pressed together, to form an adhesive bond between the blister and card. The blister and card can thus be assembled together without using conventional heat-sealing, stapling or adhesive welding methods.

Various devices are available to assist and/or automate assembly by the above-mentioned conventional methods. Heretofore, however, there has not been available a blister package assembly device for use in assembling a card and blister using a pressure-sensitive adhesive tape such as that disclosed in U.S. patent application Ser. No. 100,786. Accordingly, there is an obvious need for such a device. In particular, such a device would facilitate the commercialization of the above-described pressure sealed blister package technology by simplifying and automating the steps required to assemble blister packages of this type.

SUMMARY OF THE INVENTION

The present invention is an assembly method and device for assembling a blister and backing card of a blister package utilizing strips of double-coated adhesive tape unwound from a pair of tape rolls. The assembly device comprises a pair of feed wheels each having a plurality of substantially flat surfaces. Means for mounting said feed wheels in parallel with corresponding surfaces aligned are provided so that the feed wheels rotate synchronously. The surfaces of the feed wheels may be rotated through one or more tape wrap and transport stations and a tape application station. The assembly device further includes means for rotating the feed wheels through the stations one at a time. There are also provided first and second means for supporting said first and second rolls of double-coated tape, respectively, wherein each roll is supported to feed tape to one of said feed wheels. Tape fed onto a feed wheel is thus wrapped on the wheel as it is turned through said one or more wrap and transport stations, whereby a length of tape is transported to the application station. Cutting means are provided to cut the length of tape wrapped on a surface of said wheel at both ends to form a strip. Tray means are further provided for supporting a backing card over the surfaces of said wheels in said tape application station, and a pair of pressing rollers are provided and supported for movement over said wheels to press a card supported by said tray means against the tape supported on the parallel surfaces of said wheels in said application station, whereby tape is transferred from said surfaces of said wheels to said card.

According to another aspect of the invention, the assembly device includes a blister fixture for supporting a blister and a backing card to be assembled together, and said pressing rollers are further supported for movement over said blister fixture to press a blister against a card in said fixture whereby a taped card can be assembled to a blister to form a blister package.

DETAILED DESCRIPTION OF THE INVENTION

Figure 1:
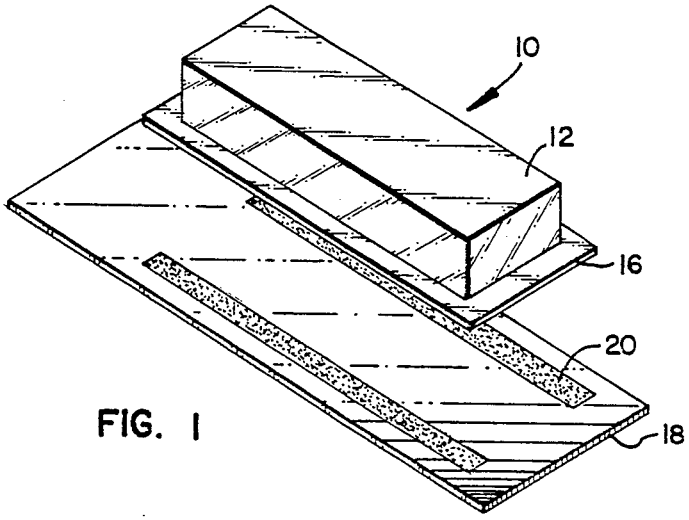
FIG. 1 is an exploded perspective view of a blister package of the type which can be assembled by the present invention.
Figure 2:
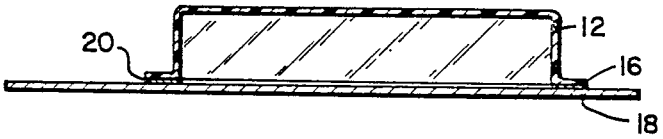
FIG. 2 is a longitudinal section view of the blister package shown in FIG. 1.

FIGS. 1 and 2 illustrate a blister package of the type which can be assembled using the device of the present invention. Blister package 10 comprises, a plastic blister 12, a blister backing card 18, and a tape 20 which bonds the plastic blister 12 to the card 18. As is conventional, plastic blister 12 is shaped to form a cavity portion 14 surrounded by a flange portion 16.

Figure 3:
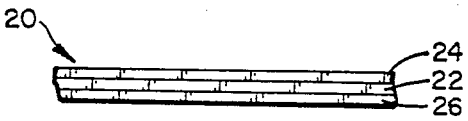
FIG. 3 is an elevational view of a double-coated tape suitable, for use with the assembly device of the present invention.

Referring now to FIG. 3, double-coated tape 20 preferably comprises a backing 22 coated on both major surfaces with layers 24 and 26 of pressure-sensitive adhesive. Preferably, the adhesive coating on one side of backing 22 is specially formulated for sealing to the card 18, which is typically a paper board product, while the other side is coated with an adhesive formulated to adhere to the plastic blister.

Because of the manner in which blister packages are expected to be displayed, i.e. hanging vertically from a display rack, the shear adhesion of the pressure-sensitive adhesive of the double-coated tape 20 must be sufficiently high so that the blister 12 does not separate from the backing card 18. Shear adhesion can be determined by a test in which a 2.54-cm wide strip of tape is obtained and the adhesive surface partially masked with paper or the like so as to leave a 2.54-cm length of adhesive exposed. The $2.54 \times 2.54$ cm square of adhesive is positioned against the polyethylene cover of a section cut from a sheet, and, using a 400-gram roller, pressed into firm contact. One end of the aforementioned section is then gripped in a pair of jaws, the free end of the tape extending downward therefrom, and a 1,000-gram weight connected to the free end of the tape. The time required for the tape to pull free from the polyethylene film is measured in minutes. A satisfactory shear adhesion value is considered to be at least three minutes, preferably at least about ten minutes.

Because of the manner in which blister packages are formed, the pressure-sensitive adhesive of the doublecoated tape 20 must have sufficient quick tack so that the package can be formed rapidly enough to be economically feasible. Quick tack can be determined by a test that is a modification of Pressure-Sensitive Tape Council test PSTC-5, described in detail in "Test Methods for Pressure-Sensitive Tapes", 6th Edition, developed by the Specifications and Technical Committee of the Pressure-Sensitive Tape Council, 1201 Waukegan Rd., Glenview, Ill. 60025, which test measure the ability of a pressure-sensitive adhesive tape to adhere to a surface instantly, using no external pressure to secure more thorough contact. It is measured as a force resisting peeling of the tape at 90° angle from a standard surface upon which it has been adhered. In accordance with the modification, the test surface is 10 mil poly(vinyl chloride) film of the type commonly employed as the outer surface of a formed blister; this film is carefully and uniformly bonded to a steel test panel. The tape is placed in contact with the poly(vinyl chloride) film and rolled down with a 100-gram roller at a rate of 30.5 cm/minute. The force required to remove a strip of tape at 90° from the exposed surface of the poly(vinyl chloride) film at a rate of 30.5 cm/minute should be at least about 100 grams per centimeter width, and preferably at least about 200 grams per centimeter width.

The peel strength of the pressure-sensitive adhesive of the double-coated tape 20 must be sufficiently high to insure package integrity. The adhesive strength between the adhesive and the backing card preferably exceeds the cohesive strength of the adhesive. It is preferred that the backing card be destroyed upon removal of the blister therefrom.

The thickness of adhesive layers 24, 26 of the double-coated tape 20 must be sufficiently low to prevent splitting but sufficiently high to allow the layers to be even. Even layers are important to insure that a strong bond be formed when the plastic sheet and closing sheet are brought together.

The preferred adhesive comprises a rubber-based adhesive and a tackifier, which preferably includes an antioxidant. Other adhesives that can be used in for tape 20 include, but are not limited to, acrylic-based adhesives. Representative examples of pressure-sensitive adhesive tapes that are suitable for tape 20 include the following adhesive tapes, all of which are available from Minnesota Mining and Manufacturing Company, St. Paul, Minn.:

No. 401, rubber adhesive, thickness of 0.009 in.
No. 415, acrylic adhesive, thickness of 0.004 in.
No. 443, rubber adhesive, thickness of 0.005 in.
No. 665, acrylic adhesive, thickness of 0.035 in.

The adhesives can be repositionable or non-repositionable. If they are non-repositionable, the blister package formed therewith will be tamperproof.

Pressure-sensitive adhesives that can be used in for tape 20 include, for example: plasticized polyisobutylene; colloidal solutions of polyvinyl ether, glycerine ester of hydrogenated resin and 2,5-di-tert-amylhydroquinone in a petroleum naphtha base; polyethylene-vinyl acetate copolymers; and ethyl cellulose plasticized with plasticizers such as diphenyl-2-ethylhexyl phosphate, dibutyl sebacate, diisobutyl adipate or acetyl tributyl citrates. In packages where the adhesive is so located as to possibly come into contact with food products enclosed by the package, the adhesive used must be non-toxic and preferably fat insoluble. Such an adhesive is available under the trade designation of "Pyroxylin 18-274-18" which is composed of polyamides, polyester plasticizers and polymerized castor oils. An adhesive of this type may be diluted for application with a mixture of aromatic solvent and aliphatic alcohol.

The means of adhesion of this invention allows the plastic sheet to be made of material thinner than that conventionally employed, resulting in cost savings. Furthermore, the closing sheet can be made of material that is not resistant to heat and pressure. For example, polymeric foams and paper can be used as material for the closing sheet. This invention eliminates the need for a packager to invest in expensive heat sealing equipment. If repositionable adhesive is not used, the blister package will also be tamperproof, as the seal cannot be remelted by means of heat.

The following, non-limiting example further illustrates the properties of tape 20.

EXAMPLE

An elastomer (1440 g), tackifier (1440 g), antioxidant (28.8 g), and solvent (3555 g) were introduced into a 5-gallon pail. The elastomer was "Kraton 1107" rubber, available from Shell Chemical Company, the tackifier was "Escorez 1310" resin, available from Exxon Chemical, the antioxidant was "AO 330" free-flowing white granular powder, available from Ethyl Corp., and the solvent was toluene. The resulting composition was mixed overnight in a laboratory churn. The solution was coated onto one major surface of a 1.2 mil biaxially oriented polypropylene sheet that had been corona treated on both major surfaces thereof by means of a knife coater. The orifice was 9 mil and the coating weight was 818 grains per 24 sq. in. The coated web was passed into a three zone oven at temperatures of 130° F., 140° F., 150° F., respectively. The resulting web was then wound on a three-inch core. Double coated silicone paper (80 lbs) was wound in. The other major surface of the polypropylene sheet was coated under the same conditions as previously described.

A sheet of backing card cardstock of the dimensions 3 11/16 in.×4 ¼ in.×24 mil was provided. The cardstock was made of paper board, white clay coated. A thermoformed blister having the following dimensions was provided:

| | |
|---|---|
| Length | 2⅞ in. |
| Width | 2 13/16 in. |
| Flange width | ¼ in. |
| Cavity size | |
| Length | 2 1/16 in. |
| Width | 2¼ in. |
| Depth | ⅝ in. |

Strips of adhesive tape were first applied to the flanges of the blister along the longer sides thereof. The blister cavity was then loaded with two 9-volt batteries, weighing a total of 92 grams. The cardstock was then adhered to the exposed surface of the adhesive tape. The blister and cardstock were pressed together to laminate the blister to the cardstock.

The blister package was hung vertically, by means of a paper clip through a hole in the cardstock, and then hung on a steel bar in a 120° F. oven for 11 days, which is equivalent to an aging period of one year. The blister did not separate from the cardstock.

Further detailed information on examples of plastic blisters, backing cards, and double-coated tapes suitable for use with the assembly device of the present invention are disclosed in the above-referenced U.S. patent application Ser. No. 100,786, entitled "Blister Packages," the entire disclosure of which is hereby incorporated herein by reference. A suitable commercially available double-coated tape is currently available from the Minnesota Mining and Manufacturing Company of St. Paul, Minn., as Tape No. 9610.

Figure 4:
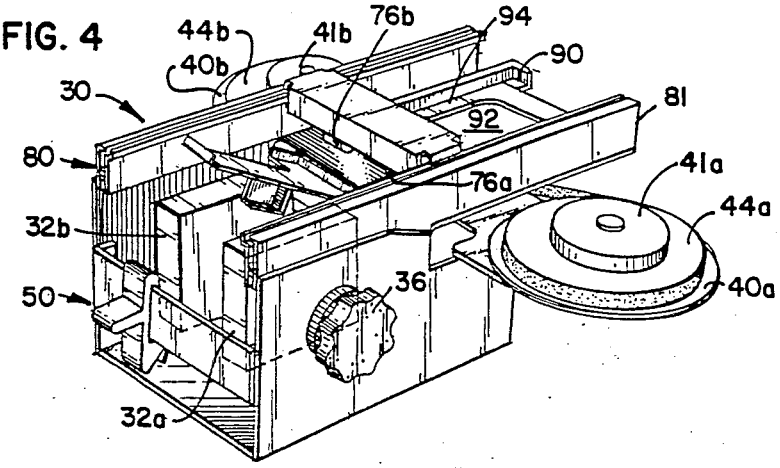
FIG. 4 is a perspective view of the assembly device according to the present invention.
Figure 6:
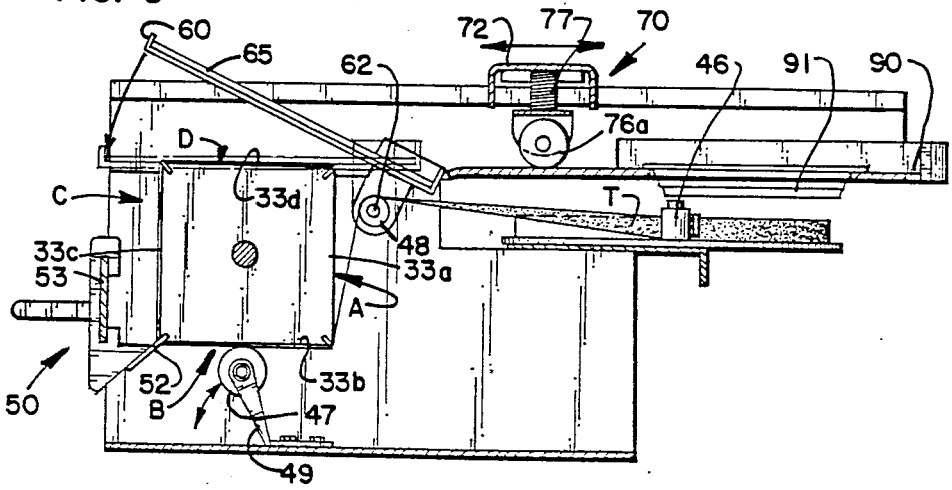
FIG. 6 is a cut-away side view of the assembly device of the present invention.
Figure 5:
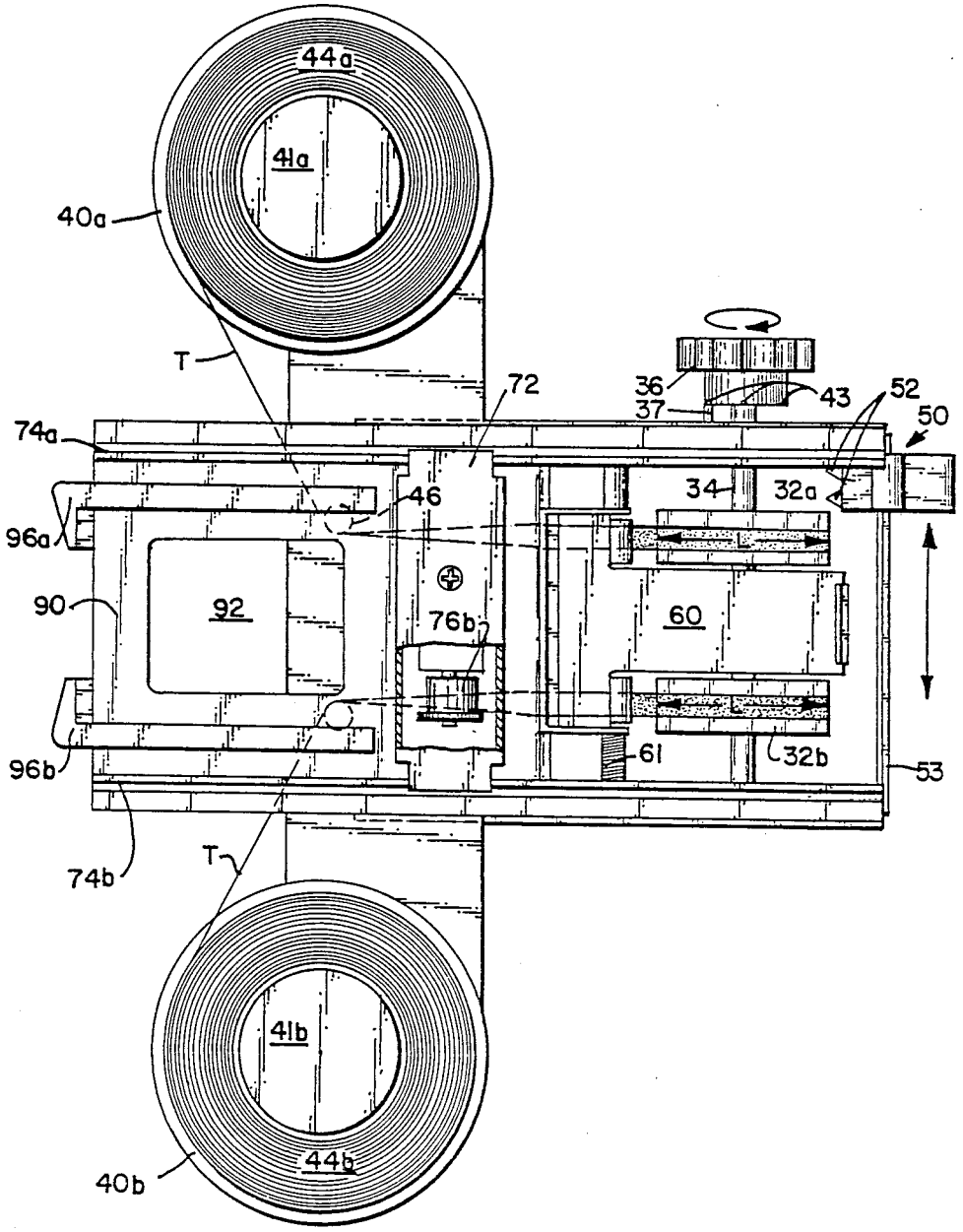
FIG. 5 is a top view of the assembly device of the present invention.

Referring now to FIGS. 4, 5, and 6 there is shown the assembly device 30 according to the present invention. Assembly device 30 includes a pair of parallel square feed wheels 32*a* and 32*b* mounted on an axle 34 for rotational movement. Each feed wheel has four flat Teflon stick free coated surfaces 33*a*–33*d*, as may be seen with respect to feed wheel 32*a*. Wheels 32*a* and 32*b* can be rotated to sequence the surfaces through the four stations indicated as A, B, C, and D, which correspond respectively to the illustrated positions of sides 33*a*, 33*b*, 33*c* and 33*d* as shown with respect to feed wheel 32*a*. A handle 36 is attached to axle 34 to rotate the wheels 32*a* and 32*b*. A ball bearing detent 37 is provided to cooperate with four circumferentially spaced recesses 43 on the back of handle 36 to help register wheels 32*a* and 32*b* in each of the four possible stations.

A pair of horizontal platters 40*a* and 40*b* having hubs 41*a* and 41*b*, respectively, are provided to support a pair of double-coated tape rolls 44*a* and 44*b*. Tape rolls 44*a* and 44*b* are supported on their sides to avoid wrapping and telescoping of the tape. As may be seen in FIGS. 5 and 6, an adjustable idler roller 46 and guide roller 48 are provided to guide and twist double-coated tape T from roll 44*a* to feed wheel 32*a*, with the coating on tape T to contact the blister facing toward wheel 32*a*. An identical adjustable idler roller and guide roller combination is provided between tape roll 44*b* and feed wheel 32*b* on the other side of assembly device 30.

In operation, tape T from a tape roll 44*a* or 44*b* is wrapped on its respective feed wheel 32*a* and 32*b* as the feed wheel rotates. Each time a feed wheel is rotated a quarter (90°) turn, a new length L of tape T is wrapped on the surface of the wheel moving from station A to position B. As the wheel is further rotated, this tape length is transported to station C and finally on to station D, the application station, from where it is applied to a backing card, as explained below. As may be seen with respect to feed wheel 32*a*, a roller 47 is provided to press wrapped tape onto the surfaces of feed wheel 32*a*. Roller 47 is mounted on an spring steel hinge member 49 and thus is resiliently biased against the surface 33*b* of the feed wheel ad can move downward and around the corner of the feed wheel as the feed wheel is rotated. Roller 47 thus aids in adhering tape T to the Teflon stick free surfaces of the feed wheel 32*a*, and helps prevent tape T from slipping backwards on the wrapping surface 33*b*. An identical roller is provided on the other side of device 30 in connection with feed wheel 32*b*. Preferably, roller 47 and its counterpart are plasma coated to prevent tape T from adhering to them.

A sliding knife assembly 50 is used to cut each end of each length of tape T wrapped on a surface of a feed wheel. The cut is made at the corner of the wheel in the position intermediate sides 33*a* and 33*b* as can be seen with respect to wheel 32*a*. Accordingly, when a length L of tape reaches the application station (station D), it has been cut on both ends, whereby a length L of double-coated tape T is readied to be applied to a backing card.

Figure 7:
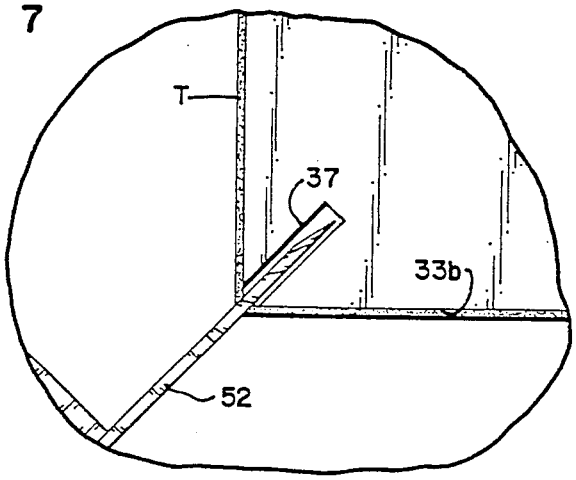
FIG. 7 is an enlarged fragmentary side view of a feed wheel and sharing the tip of the cutting tool according to the present invention.

To facilitate the cutting of tape T, the corners of each of feed wheels 32*a* and 32*b* are slotted, as may be seen with respect to slot 37 shown in the partial view of FIG. 7. Sliding knife assembly 50 includes cutting blades 52 and is slidably mounted on rail 53 for back and forth shuttle movement. Blades 52 are positioned to cut the portion of tape T where it traverses the slotted corner of the feed wheels. After each quarter turn of the wheel the assembly 50 is shuttled back and forth to cut the tape on both wheels.

A card tray 60 is provided to assist in locating a backing card over the surfaces of feed wheels 32*a* and 32*b* located in the application station (station D), whereby the tape carried on the wheels can be transferred to the card. Card tray 60 is pivotably mounted on an axle 62 and spring biased with spring 61 to the load/unload position shown in solid lines in FIG. 6. Card tray 60 can be pivoted to an application position, which is shown in phantom lines in FIG. 6.

A press assembly 70 is provided to press a card 65 loaded in tray 60 down and on top of feed wheels 32*a* and 32*b*. Press assembly 70 includes a carriage 72 mounted on rails 74*a* and 74*b*. A pair of rubber resilient pressing rollers 76*a* and 76*b* are carried by carriage 72 and are spring loaded with springs 77 to provide a preselected load pressure. Pressing rollers may be constructed of silicone rubber, for example. Press rollers 76*a* and 76*b* move the card and tray from the load/unload position to the application position as the pressing assembly is moved over the tray and card toward end 80 of rails 74*a* and 74*b*, pressing the card against the tape strips. When assembly 70 is returned to its center position as it is shown in FIG. 6, the spring bias on tray 60 lifts the card up and away from the application surfaces of feed wheels 32*a* and 32*b*, lifting the parallel tape strips from the wheel. Two strips of tape of length L are thus transferred from the wheels to the card, and the backing card is prepared to be sealed to a blister pack. Preferably, the preselected load pressure of the rollers 76*a* and 76*b* is selected to provide sufficient surface energy to accomplish a complete transfer of the tape length to the card. The Teflon stick free coating on the wheel 32*a* and 32*b* surfaces facilitates the release of the tape to the card.

The other end of assembly device 30 includes a blister fixture 90 supported for holding a blister 91 to be loaded with product and sealed to the prepared backing card. Fixture 90 includes an opening 92 in which the cavity portion of the blister is placed, and surrounding land area 94, or ledge, for supporting the flanges of the blister. Fixture 90 further includes guide portions 96*a* and 96*b* to help guide a prepared, taped card into proper alignment and registration with the blister 91.

Press assembly 70 has a dual capacity and also functions to seal the blister and card together in fixture 90. Rails 74*a* and 74*b* extend to end 81 of device 30 so that press assembly 70 can be shuttled back and forth over the card and blister held in fixture 90 to press the card and tape strips carried thereon against the side flanges of the blister to seal the package together. Preferably, the rollers 76*a* and 76*b* press with enough energy to facilitate the formation and growth of the adhesive bond between the blister and card. Once the blister and card have been sealed together with the press assembly 70, the package is assembled and can be removed from the fixture 90.

To continue with the assembly of another blister package, feed wheels 32*a* and 32*b* are rotated another quarter turn (making sure that the tape has been cut with knife assembly 50) bringing the tape length L carried on the surface of the feed wheels in station C to the application station (station D). At the same time the tape length carried on the side in station B is rotated to station C, while the surface in the idle station A becomes wrapped with a new length of tape T and assumes station B. With two new strips of tape in the application station of the wheels, a fresh backing card may be loaded into tray 60 and the above-described process repeated to assemble a further blister package.

Various changes and modifications to the above-described assembly device 30 are contemplated. For instance, the feed wheels 32*a* and 32*b* need not be square. They could, for instance, be planar with two sides, triangular with three sides or have more than four sides. All that is required is that at least one side be available to wrap tape T on as it is pulled from the roll, while at least one other side is available as an application surface. Other card tray arrangements are also contemplated. For example, the tray could be mounted in a fixed position wherein the card would be loaded and unloaded directly from the application surfaces of the feed wheel. In this case the tray would merely serve as a guide to properly locate and register the card over the feed wheels. Different systems for pressing the paper board card to the application surfaces of the feed wheels are also contemplated. Further, it is contemplated that the tape rolls could be vertically supported as opposed to horizontally supported, and that the order of assembly of the package could be reversed wherein the tape would be applied from the feed wheels to the blister and thereafter sealed to the card. Alternatively, both sides of the blister package could be plastic blisters. Furthermore, it is contemplated that the tape application station of the device 30 could be separated from the function of device 30 to press the card and blister together, or that two separate pressing assemblies could be provided to perform the separate functions of applying tape and pressing the cord and blister together.

An automated embodiment of device 30 is also contemplated. For example, feed wheel 32*a* and 32*b*, knife assembly 50 and press assembly 70 could be motor, pneumatically, or hydraulically actuated in a predetermined sequence, with the card, blister and its selected content being automatically loaded and unloaded.

Although the invention has been described herein in its preferred form, those skilled in the art will recognize that many changes, modifications and additions may be made thereto without departing from the spirit and scope of the claims appended hereto.

What is claimed:

1. An assembly device for use in assembling the blister and backing card components of a blister package, said blister and card components adhered together using parallel strips of double-coated tape obtained from a pair of tape rolls, comprising:

a pair of feed wheels each having a plurality of substantially flat surfaces;

mounting means for mounting said feed wheels in parallel with corresponding surfaces aligned for synchronous rotation so that the surfaces of the wheels rotate through one or more tape wrap and transport stations and a tape application station;

rotating means for rotating said feed wheels through said stations one at a time;

first tape support means for supporting one of said rolls of tape to feed to one of said pair of feed wheels;

second tape support means for supporting the other of said rolls of tape to feed the other of said pair of feed wheels;

whereby tape fed to a feed wheel is wrapped on said wheel as it is turned through said one or more wrap and transport stations and whereby a length of tape is transported to the application station;

tape cutting means for cutting the end of a length of tape wrapped on each of said feed wheels whereby the tape carried on said feed wheels can be cut into strips;

tray means for supporting one of said components over the surfaces of said wheels in said tape application station; and pressing means for pressing said component supported by said tray means against the tape supported on the parallel surfaces of said wheels in said application station whereby tape is transferred from said surfaces of said wheels to said component.

2. An assembly device according to claim 1 further including:

a fixture for supporting said blister and backing card components to be assembled together; and further pressing means for pressing said blister and card components against one another in said fixture whereby a taped component can be assembled to the other component to form a blister package.

3. An assembly device according to claim 1 or 2 further including first and second tape wrap roller means, each of said tape wrap roller means movably mounted with a resilient bias against the surface of one of said feed wheels in said tape wrap station to aid in adhering said tape to the feed wheel.

4. An assembly device according to claim 1 wherein said pressing means includes pressing rollers supported for rolling movement over said wheels.

5. An assembly device according to claim 4 wherein said pressing means further includes:

a carriage for supporting said pressing rollers; and track means for supporting said carriage for linear movement.

6. An assembly device according to claim 2 further wherein said pressing means and said further pressing means comprise:

a pair of pressing rollers;

a carriage for supporting said rollers; track means for supporting said carriage for linear movement over said wheels for movement over said fixture; and further wherein said carriage has a center position along said track means between said fixture and said feed wheels, wherein when said carriage is moved in a first direction said pressing rollers pass over said feed wheels, and wherein when said carriage is moved in the other direction the pressing rollers pass over said blister fixture.

7. An assembly device according to claim 1 or 2 wherein said tray means is mounted for movement between a first load/unload position that is spaced apart from said feed wheels and a second application position wherein said tray means supports said component over the surfaces of said wheels.

8. An assembly device according to claim 7 wherein said means for moving said tray means includes means for spring biasing said tray means toward said first position

9. An assembly device according to claim 1 wherein said first and second means for supporting said rolls of tape each include a horizontally mounted rotating platter and further wherein said device includes means for guiding tape from each of the rolls supported on said platters to said feed wheels.

10. A method for use in assembling the blister and backing card components of a blister package using parallel strips of double-coated tape obtained from a pair of tape rolls, comprising the steps of:

(a) providing a pair of feed wheels each having a plurality of substantially flat surfaces;

(b) supporting said feed wheels in parallel with corresponding surfaces aligned for synchronous rotation so that the surfaces of the wheels can be rotated through one or more tape wrap and transport stations and a tape application station;

(c) supporting one of said rolls of tape to feed to one of said pair of feed wheels;

(d) supporting the other of said rolls of tape to feed the other of said pair of feed wheels;

(e) rotating said feed wheels so that tape fed to a feed wheel is wrapped on said wheel as it is turned through said one or more wrap and transport stations and whereby a length of tape is transported to the application station;

(f) cutting the ends of a length of tape wrapped on a surface of said feed wheels whereby the tape carried on said feed wheels is cut into strips;

(g) positioning one of said components over the parallel and aligned surfaces of said wheels in said tape application station; and (h) pressing said component against said wheels whereby tape is transferred from said surfaces of said wheels to said component.

11. A method according to claim 10 further including the steps of:

(a) providing a fixture for supporting said blister and backing card components to be assembled together; and (b) pressing said components together along the area of said tape strips carried on one of said components whereby a taped component can be assembled to the other component to form a blister package.

12. An assembly device for use in assembling the blister and backing card components of a blister package, said blister and card components adhered together using parallel strips of double-coated tape obtained from a pair of tape rolls, comprising:

a pair of rectangular feed wheels each having four substantially flat surfaces;

mounting means for mounting said feed wheels in parallel with corresponding surfaces aligned for synchronous rotation so that the surfaces of the wheels rotate through an idle, station tape wrap station and application station;

rotating means for rotating said feed wheels through said stations one at a time;

first tape support means for supporting one of said rolls of tape on its side to feed to one of said pair of feed wheels;

second tape support means for supporting the other of said rolls of tape on its side to feed the other of said pair of feed wheels;

first and second tape wrap roller means, each of said tape wrap roller means movably mounted with a resilient bias against the surface of one of said feed wheels in said tape wrap station to aid in adhering said tape to the feed wheel;

whereby tape fed to a feed wheel is wrapped on said wheel as it is turned through said wrap and transport stations and whereby a length of tape is transported to the application station;

tape cutting means for cutting the end of a length of tape wrapped on each of said feed wheels whereby the tape carried on said feed wheels can be cut into strips;

tray means for supporting one of components over the surfaces of said wheels in said tape application station;

a pair of pressing rollers; and support means for supporting said pressing rollers for movement over said wheels to press component supported by said tray means against the tape supported on the parallel surfaces of said wheels in said application station whereby tape is transferred from said surfaces of said wheels to said component.

13. An assembly device according to claim 12 further including:

a fixture for supporting said blister and backing card components to be assembled together; and further support means for supporting said pressing rollers for movement over said fixture to press said blister component against said card in said fixture whereby a taped component can be assembled to the other component to form a blister package.

* * * * *

UNITED STATES PATENT AND TRADEMARK OFFICE

CERTIFICATE OF CORRECTION

PATENT NO. : 4,848,066

DATED : July 18, 1989

INVENTOR(S) : Robert A. Luhman

It is certified that error appears in the above-identified patent and that said Letters Patent is hereby corrected as shown below:

Col. 2, line 14, after "suitable" delete the comma.

Col 2, lines 65-66, "doublecoated" should be --double-coated--.

Col.3, line 6, "measure" should be --measures--.

Col. 5, line 9 and line 47, "Teflon" should be --TEFLON--.

Col. 5, line 45, "ad" should be --and--.

Col. 6, line 36, "Teflon" should be --TEFLON--.

Col. 7, line 34, "cord" should be --card--.

Col. 7, line 36, "wheel" should be --wheels--.

Col. 8, line 43, "track" should begin a new paragraph.

Col. 10, line 4, comma after "idle" should be after --station--.

Col. 10, line 10, after "of" insert --said--.

UNITED STATES PATENT AND TRADEMARK OFFICE

CERTIFICATE OF CORRECTION

PATENT NO. : 4,848,066

DATED : July 18, 1989

INVENTOR(S) : Robert A. Luhman

It is certified that error appears in the above-identified patent and that said Letters Patent is hereby corrected as shown below:

Col. 10, line 32, after "press" insert --said--.

Signed and Sealed this

Twenty-first Day of August, 1990

*Attest:*

HARRY F. MANBECK, JR.

*Attesting Officer*

*Commissioner of Patents and Trademarks*